United States Patent [19]

Dutcher

[11] 4,024,657

[45] May 24, 1977

[54] PROMOTIONAL DEVICE

[75] Inventor: Freda M. Dutcher, Franklin, Mich.

[73] Assignee: Michaleen Huff, Birmingham, Mich. ; a part interest

[22] Filed: Mar. 31, 1976

[21] Appl. No.: 672,385

[52] U.S. Cl. ..... 40/126 R; 46/135 R

[51] Int. Cl.[2] ..... G09F 19/00

[58] Field of Search ..... 40/126 R, 82, 1, 19, 40/106.31, 106.32, 106.43; 273/58 R, 58 A; 46/135, 171

[56] References Cited

UNITED STATES PATENTS

| | | | |
|---|---|---|---|
| 889,714 | 6/1908 | McDonald | 40/1.6 |
| 1,352,047 | 9/1920 | Boje, Jr. | 46/135 X |
| 2,960,794 | 11/1960 | Johns | 273/58 K X |
| 3,711,976 | 1/1973 | Allen | 40/82 |

*Primary Examiner*—John F. Pitrelli
*Assistant Examiner*—Robert F. Cutting
*Attorney, Agent, or Firm*—Harness, Dickey & Pierce

[57] ABSTRACT

A promotional device comprising a hollow rubber ball with a curved slit to simulate a mouth, ornamental eyes and a tag secured to the top. A strip has a message printed thereon and its outer portion is colored red to simulate a tongue. The strip is coiled up and inserted in the mouth slit. The tag will direct a recipient to pull the tongue, thus uncoiling the strip so that the message may be read.

6 Claims, 3 Drawing Figures

PROMOTIONAL DEVICE

BACKGROUND OF THE INVENTION

1. Field of the Invention

The invention relates to promotional devices such as are used for advertising purposes, party invitations or charitable solicitations, and which have messages which are to be delivered to a recipient in an unusual or amusing manner.

2. Description of the Prior Art

Baldwin et al U.S. Pat. No. 2,954,628 and Ortega U.S. Pat. No. 3,696,540 show promotional devices having rolled-up messages which are released by the user, the Baldwin et al patent having a message inside a pencil and the Ortega patent showing a cigar from which the message is unrolled. Neither of these devices is believed to incorporate the amusing and highly unusual aspects of the present invention. Patents showing balls or other rubber objects with tongues or extensions include Casey et al U.S. Pat. No. 2,324,277 and Boje, Jr. U.S. Pat. No. 1,352,047. These patents, however, do not constitute promotional devices, nor do they have the other features and advantages of the invention as described below.

BRIEF SUMMARY OF THE INVENTION

It is an object of the present invention to provide a novel and improved promotional device which has jovial and entertaining qualities not found in previously known devices used for this purpose.

It is another object to provide an improved promotional device of this character which is extremely economical and simple to make, requiring only the most inexpensive and easily accessible materials and capable of being put together by youngsters as well as adults.

Briefly, the promotional device comprises a hollow rubber ball, a slit in said ball, a pair of simulated eyes attached to said ball above said slit, and a strip of flexible material carrying indicia forming a message, said strip being partially coiled up and the coiled portion inserted through said slit so as to be held within the ball, the uncoiled portion of the strip protruding from the slit so as to simulate a tongue which may be grasped and pulled out.

DESCRIPTION OF THE PREFERRED EMBODIMENT

Figure 1:
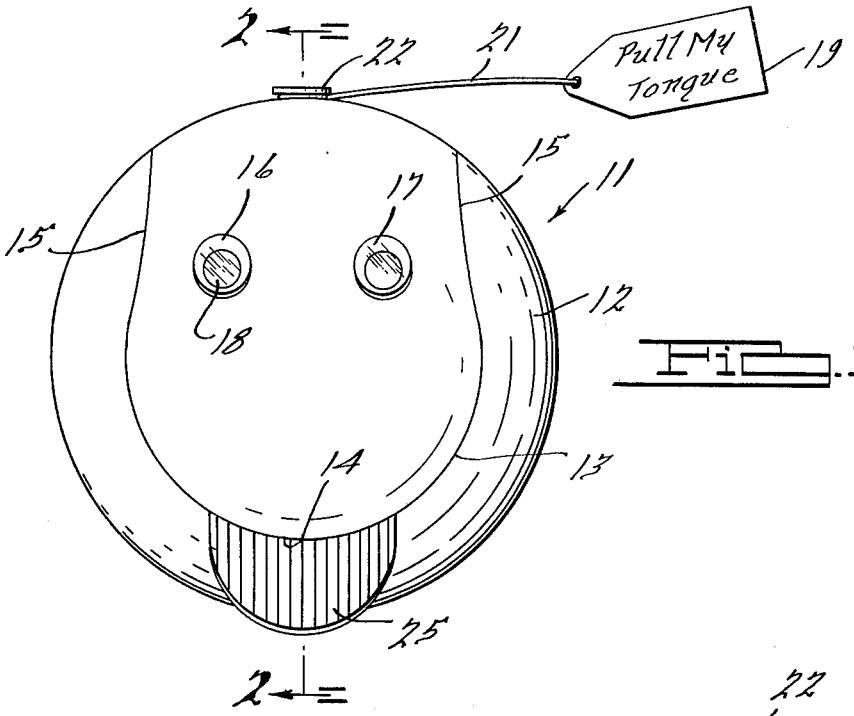
FIG. 1 is a front elevational view of the promotional device.

The promotional device is generally indicated at 11 and comprises a ball 12 such as a tennis ball which is hollow and constructed of rubber. The ball has a conventional seam 13. In accordance with the invention, a slit 14 is cut along a curved portion of seam 13 as shown in FIG. 1. This slit is preferably along a portion of the seam having a constant curvature so that the relatively straight portions 15 of the seam may extend upwardly therefrom on either side.

A pair of eyes 16 and 17 are secured to the ball between straight portions 15. These eyes may be conventional paste-on eyes found in novelty stores with movable opaque buttons 18 inside a transparent shell. The location of eyes 16 and 17 is substantially above slit 14.

A tag 19 is secured to the top of ball 12 above eyes 16 and 17. The tag is attached by means such as a string 21 and a rivet or thumbtack 22. A legend such as "Pull My Tongue" is imprinted on tag 19, which because of the location of fastener 22, appears to be at the top of the head which the ball will simulate.

A strip 23 is provided, this strip being made of a material such as sized cloth. One suitable material would be percale which could be sprayed with instant sizing to make the cloth firmer and easier to write on. The width of strip 23 may be approximately the same as slit 14.

The outer edge 24 of strip 23 is curved to simulate the end of the tongue, and the area 25 adjacent this edge is colored red. Coloring material such as ink could be used for this purpose.

The remaining area of strip 23 is used for a message indicated at 26. This area may be left uncolored and the message could be imprinted in any suitable manner. Samples of messages would be for party invitations, advertising purposes or other promotional or charitable solicitations.

Figure 2:
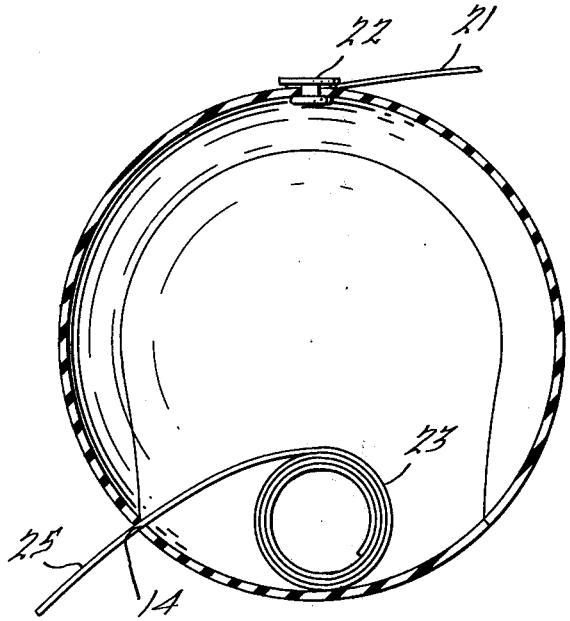
FIG. 2 is a side cross-sectional view in elevation taken along the line 1—2 of FIG. 1.
Figure 3:
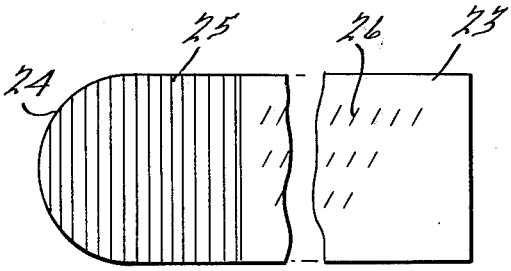
FIG. 3 is a plan view of the strip shown in its uncoiled position, parts being broken away.

After preparing the strip 23, it is coiled up as shown in FIG. 2 with the outer portion 25 left uncoiled. The coiled portion of strip 23 is forced through slit 14 which, because the ball is made of rubber, is eaily spread apart. After the coil has been forced into the ball, it will assume the position shown in FIG. 2 with area 25 projecting from slit 14 and simulating the tongue of a human head.

FIG. 1 shows the total appearance of the assembly, indicating the amusing aspect of a rotund human head with a tag on its bald head, round eyes and a tongue hanging from a grinning mouth. The person receiving the ball will read tag 19 and grasp portion 25 of strip 23, pulling it out and thereby uncoiling the stip. He will thereupon read the message imprinted on the strip 23.

It should be noted that the ball is reuseable in that different strips 23 having various messages could be placed therein.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A promotional device comprising a hollow rubber ball, a slit in said ball whereby squeezing of the ball will cause air to be expelled therethrough, a pair of simulated eyes attached to said ball above said slit, and a strip of flexible material carrying indicia forming a message, said strip being partially coiled up and the coiled portion inserted through said slit so as to be held within the ball but unattached thereto, the uncoiled portion of the strip protruding from the slit so as to simulate a tongue which may be grasped and pulled out and completely removed from said ball whereby said message may be read.

2. A promotional device comprising a hollow rubber ball, a slit in said ball whereby squeezing of the ball will cause air to be expelled therethrough, a pair of simulated eyes attached to said ball above said slit, a tag secured to said ball above said eyes, and a strip of flexible material carrying indicia forming a message, said strip being partially coiled up and the coiled portion inserted through said slit so as to be held within the ball but unattached thereto, the uncoiled portion of the strip protruding from the slit so as to simulate a tongue which may be grasped and pulled out and completely removed from said ball whereby said message may be read.

3. A promotional device according to claim 2, said ball comprising a tennis ball having a conventional seam with curved portions and relatively straight portions, said slit being formed along one of said curved portions, said eyes being located between said straight portions.

4. A promotional device according to claim 2, said tag being secured to the top of said ball by a string and a fastener securing said string to said ball.

5. A promotional device according to claim 2, said strip being fabricated of cloth, the protruding portion of said strip being colored red.

6. A promotional device comprising a hollow rubber tennis ball having a conventional seam with curved and straight portions, a slit cut along a curved portion of said seam to simulate a mouth, a pair of conventional paste-on button eyes secured to said tennis ball between the straight portions of said seam above and slit, a tag secured to the top of said tennis ball, a cloth message strip, the main portion of said message strip having indicia forming a message and being coiled up, the outer portion of said strip being colored red with its end curved to simulate a tongue, said coiled portion of the strip being inserted through said slit into the interior of said tennis ball so that the tongue portion will protrude through the slit and may be pulled to expose the entire strip.

* * * * *

UNITED STATES PATENT AND TRADEMARK OFFICE

CERTIFICATE OF CORRECTION

PATENT NO. : 4,024,657

DATED : May 24, 1977

INVENTOR(S) : Freda M. Dutcher

It is certified that error appears in the above-identified patent and that said Letters Patent are hereby corrected as shown below:

Column 1, line 51: "1-2" should be --2-2--

Column 4, line 9: "and" should be --said--

Signed and Sealed this second Day of August 1977

[SEAL]

*Attest:*

RUTH C. MASON
*Attesting Officer*

C. MARSHALL DANN
*Commissioner of Patents and Trademarks*